US006109254A

United States Patent [19]

Reinke et al.

[11] Patent Number: 6,109,254

[45] Date of Patent: Aug. 29, 2000

[54] CLAMSHELL HEAT EXCHANGER FOR A FURNACE OR UNIT HEATER

[75] Inventors: Michael J. Reinke, Franklin; Richard Mark DeKeuster, Racine, both of Wis.

[73] Assignee: Modine Manufacturing Company, Racine, Wis.

[21] Appl. No.: 08/946,338

[22] Filed: Oct. 7, 1997

[51] Int. Cl.[7] ..... F24H 3/02

[52] U.S. Cl. ..... 126/110 R; 126/99 R; 165/170; 165/147

[58] Field of Search ..... 126/110 R, 116 R, 126/99 R, 99 C; 165/147, 170, 174

[56] References Cited

U.S. PATENT DOCUMENTS

| | | | |
|---|---|---|---|
| 2,751,900 | 6/1956 | Modine . | |
| 3,661,140 | 5/1972 | Raleigh . | |
| 4,154,213 | 5/1979 | Winters . | |
| 4,298,061 | 11/1981 | Hoeffken . | |
| 4,467,780 | 8/1984 | Ripka | 126/110 R |
| 4,476,850 | 10/1984 | Pickering . | |
| 4,510,660 | 4/1985 | Hoeffken . | |
| 4,538,338 | 9/1985 | Hoeffken et al. . | |
| 4,547,943 | 10/1985 | Hoeffken . | |
| 4,570,612 | 2/1986 | Ripka et al. . | |
| 4,730,600 | 3/1988 | Harrigill . | |
| 4,739,746 | 4/1988 | Tomlinson . | |
| 4,779,676 | 10/1988 | Harrigill . | |
| 4,848,314 | 7/1989 | Bentley . | |
| 4,867,673 | 9/1989 | Harrigill . | |
| 4,877,014 | 10/1989 | Beasley . | |
| 4,887,959 | 12/1989 | Shellenberger . | |
| 4,893,390 | 1/1990 | Hoeffken . | |
| 4,924,848 | 5/1990 | Vaughn . | |
| 4,945,890 | 8/1990 | Ripka . | |
| 4,955,359 | 9/1990 | Briggs et al. . | |
| 4,960,102 | 10/1990 | Shellenberger . | |
| 4,974,579 | 12/1990 | Shellenberger et al. . | |
| 4,982,785 | 1/1991 | Tomlinson . | |
| 4,987,881 | 1/1991 | Narang . | |
| 5,042,453 | 8/1991 | Shellenberger . | |
| 5,052,345 | 10/1991 | Byström et al. . | |
| 5,060,722 | 10/1991 | Zdenek et al. . | |
| 5,062,409 | 11/1991 | Kamanaka et al. . | |
| 5,065,736 | 11/1991 | Mutchler . | |
| 5,074,280 | 12/1991 | Evens . | |
| 5,094,224 | 3/1992 | Diesch . | |
| 5,097,802 | 3/1992 | Clawson . | |
| 5,105,798 | 4/1992 | Evens . | |

(List continued on next page.)

FOREIGN PATENT DOCUMENTS

| | | | |
|---|---|---|---|
| 537408 | 1/1980 | Australia | 126/675 |
| 42553 | 6/1930 | Denmark | 165/170 |

*Primary Examiner*—James C. Yeung
*Attorney, Agent, or Firm*—Wood, Phillips, VanSanten, Clark & Mortimer

[57] ABSTRACT

A clamshell heat exchanger (10) is provided for use in a heating apparatus including a burner for producing hot combustion gas. The heat exchanger (10) defines a multi-pass flow passage (11) for the combustion gas and includes a first plate member (30) and a second plate member (32). The first plate member (30) has a first series of parallel ridges (36) and valleys (38*a–b*), with at least one of the valleys (38*a*) being deeper than other of the valleys (38*b*). The second plate member (32) faces the first plate member (30) and includes a second series of ridges (36) and valleys (38*a–b*) that are parallel to the first series of ridges (36) and valleys (38*a–b*), with at least one of the valleys (38*a*) of the second series being deeper than other of the valleys (38*b*) of the second series. A first pass (14, 16) of the multi-pass flow passage (11) is defined by a number N1 of the ridges (36) and valleys (38*a–b*) of the first and second series. A second pass (16, 18) of the multi-pass flow passage (11) is defined by a number N2 of the ridges (36) and valleys (38*a–b*) of the first and second series. The at least one deeper valley (38*a*) of the first series cooperates with the at least one deeper valley (38*a*) of the second series to separate the second pass (16, 18) from the first pass (14, 16).

7 Claims, 4 Drawing Sheets

U.S. PATENT DOCUMENTS 5,113,844 5/1992 Cook .
5,141,152 8/1992 Spanko .
5,142,895 9/1992 Schuchert .
5,146,910 9/1992 Grahl et al. .
5,165,386 11/1992 Van Der Veen .
5,176,512 1/1993 Evens .
5,195,580 3/1993 Hoeffken .
5,201,651 4/1993 Niksic et al. .
5,205,276 4/1993 Aronov et al. .
5,222,552 6/1993 Schuchert .
5,271,376 12/1993 Lu et al. .
5,284,041 2/1994 Christensen et al. .
5,295,473 3/1994 Neufeldt .
5,301,654 4/1994 Weber, III et al. .
5,309,890 5/1994 Rieke et al. .
5,309,892 5/1994 Lawlor .
5,322,050 6/1994 Lu .
5,333,597 8/1994 Kirkpatrick et al. .
5,345,924 9/1994 Rieke et al. .
5,346,001 9/1994 Rieke et al. .
5,346,002 9/1994 Swilik, Jr. et al. .
5,359,989 11/1994 Chase ..... 126/110 R
5,368,010 11/1994 Weber, III et al. .
5,368,011 11/1994 Bodner .
5,368,012 11/1994 Chamberlain .
5,370,529 12/1994 Lu et al. .
5,375,586 12/1994 Schumacher et al. .
5,379,750 1/1995 Larsen et al. .
5,379,751 1/1995 Larsen et al. .
5,380,193 1/1995 Williams et al. .
5,402,567 4/1995 Riehl .
5,406,933 4/1995 Lu .
5,406,934 4/1995 Cain .
5,417,199 5/1995 Jamieson et al. .
5,437,263 8/1995 Ellingham et al. .
5,448,986 9/1995 Christopher et al. ..... 126/110 R

CLAMSHELL HEAT EXCHANGER FOR A FURNACE OR UNIT HEATER

FIELD OF THE INVENTION

This invention relates to heat exchangers, and more particularly, to clamshell heat exchangers for use in heating apparatuses such as gas fired, hot air furnaces or unit heaters.

BACKGROUND OF THE INVENTION

It is known to construct the heat exchangers for gas fired, hot air furnaces from a pair of metal plates or sheets secured in face to face relationship to form a multi-pass flow passage for the hot combustion gas of the furnace. This type of heat exchanger is commonly referred to as a multi-pass clamshell heat exchanger. Typically, the multi-pass flow passage includes an inlet section an outlet section, and one or more passes connecting the inlet and outlet sections. The inlet section receives hot combustion gases from a burner, such as an inshot burner, and provides a combustion zone for the gases. The outlet section communicates with an induction draft blower or power vent which serves to draw the hot combustion gases through the multi-pass flow passage of the heat exchanger. As the combustion gas flows through the heat exchanger, it cools and becomes more dense. To maintain high gas velocity, it is known to decrease the flow area of the heat exchanger from pass to pass. It is common for a gas fired furnace to include a plurality of such clamshell heat exchangers, spaced apart in a parallel array to define air flow paths so that heat may be transferred from the hot combustion gas through the plates of the heat exchangers to the air flowing through the furnace. Examples of such clamshell heat exchangers are shown in U.S. Pat. No. 5,359,989 issued Nov. 1, 1994 to Chase et al., and U.S. Pat. No. 4,467,780 issued Aug. 28, 1984 to Ripka, the complete disclosures of which are incorporated herein by reference.

One problem commonly found in known clamshell heat exchangers are the relatively sharp angle bends that result from the formation of the hot gas combustion flow passage in the sheet metal. For example, the clamshell heat exchanger (12) in the U.S. Pat. No. 5,359,989 requires four relatively sharp angle bends for each passage (24*a*, 25*a–c*, 26*a–c*, and 27*a–c*). Such sharp angle bends produce localized material stretching that can reduce or damage anti-corrosion coatings on the surface of the material, thereby increasing the likelihood of premature corrosion failure.

Further, while many known clamshell heat exchangers perform satisfactorily, there is a continuing desire to produce more compact and efficient furnaces by decreasing the size of the heat exchangers and/or increasing the heat exchanger's performance characteristics.

SUMMARY OF THE INVENTION

It is the principal object of the invention to provide a new and improved heat exchanger, and more specifically to provide a relatively compact heat exchanger for use in heating apparatuses, such as gas fired, hot air furnaces or unit heaters, that provides improved heat transfer capabilities and/or decreases the likelihood of premature corrosion failure.

According to one facet of the invention, a clamshell heat exchanger is provided for use in a heating apparatus including a burner for producing hot combustion gas. The heat exchanger receives combustion gas from the burner and rejects heat from the combustion gas to air flowing through the furnace. The heat exchanger defines a multi-pass flow passage for the combustion gas and includes a first plate member and a second plate member. The first plate member has a first series of parallel ridges and valleys, with at least one of the valleys being deeper than other of the valleys. The second plate member faces the first plate member and includes a second series of ridges and valleys that are parallel to the first series of ridges and valleys, with at least one of the valleys of the second series being deeper than other of the valleys of the second series. A first pass of the multi-pass flow passage is defined by a number N1 of the ridges and valleys of the first and second series. A second pass of the multi-pass flow passage is defined by a number N2 of the ridges and valleys of the first and second series. The numbers N1 and N2 are different integers. The at least one deeper valley of the first series cooperates with the at least one deeper valley of the second series to separate the second pass from the first pass.

In one form, the number N2 is less than the number N1.

According to one facet of the invention, the clamshell heat exchanger includes a first plate member having a first wall section that is non-parallel to the plane of the heat exchanger, and a second plate member having a second wall section that is parallel to the first wall section and abutting the first wall section over a common length. A first pass of a multi-pass flow passage is defined by the first and second plates, and a second pass of the multi-pass flow passage is defined by the first and second plates. The second pass is parallel to the first pass and separated from the first pass by the first and second abutting wall sections.

According to one facet of the invention, the heat exchanger includes a first pass having a generally sinusoidal-shaped cross-sectional flow area, and a second pass downstream from the first pass and having a second generally sinusoidal-shaped cross-sectional flow area. The second flow area is less than the first flow area.

According to another facet of the invention, the heat exchanger includes a first planar metallic plate and a second planar metallic plate. The first planar metallic plate has at least two sections of parallel ridges displaced to one side of the plane of the first plate, valleys between the ridges, and a valley separating the sections and extending to the other side of the plane of the first plate. The second plate has at least two sections of parallel ridges displaced to the side of the second plate remote from the other side of the first plate, valleys between the ridges in the second plate, and a valley separating the sections on the second plate and extending to the side of the plane of the second plate opposite the remote side to at least nominally seal along its length with the valley separating the sections of the first plate. The ridges in the two plates are oppositely directed and generally parallel to each other to form pairs of the sections. The valleys of the second plate are nominally aligned with the ridges on the first plate. The heat exchanger further includes a combustion gas inlet to one pair of the sections, a combustion gas outlet from another pair of the sections, and a conduit formed at the interface of the plates and interconnecting the one pair of sections to said another pair of sections.

Other objects and advantages of the invention will become apparent from the following specification taken in conjunction with the accompanying drawings.

DETAILED DESCRIPTION OF THE PREFERRED EMBODIMENTS

Figure 1:
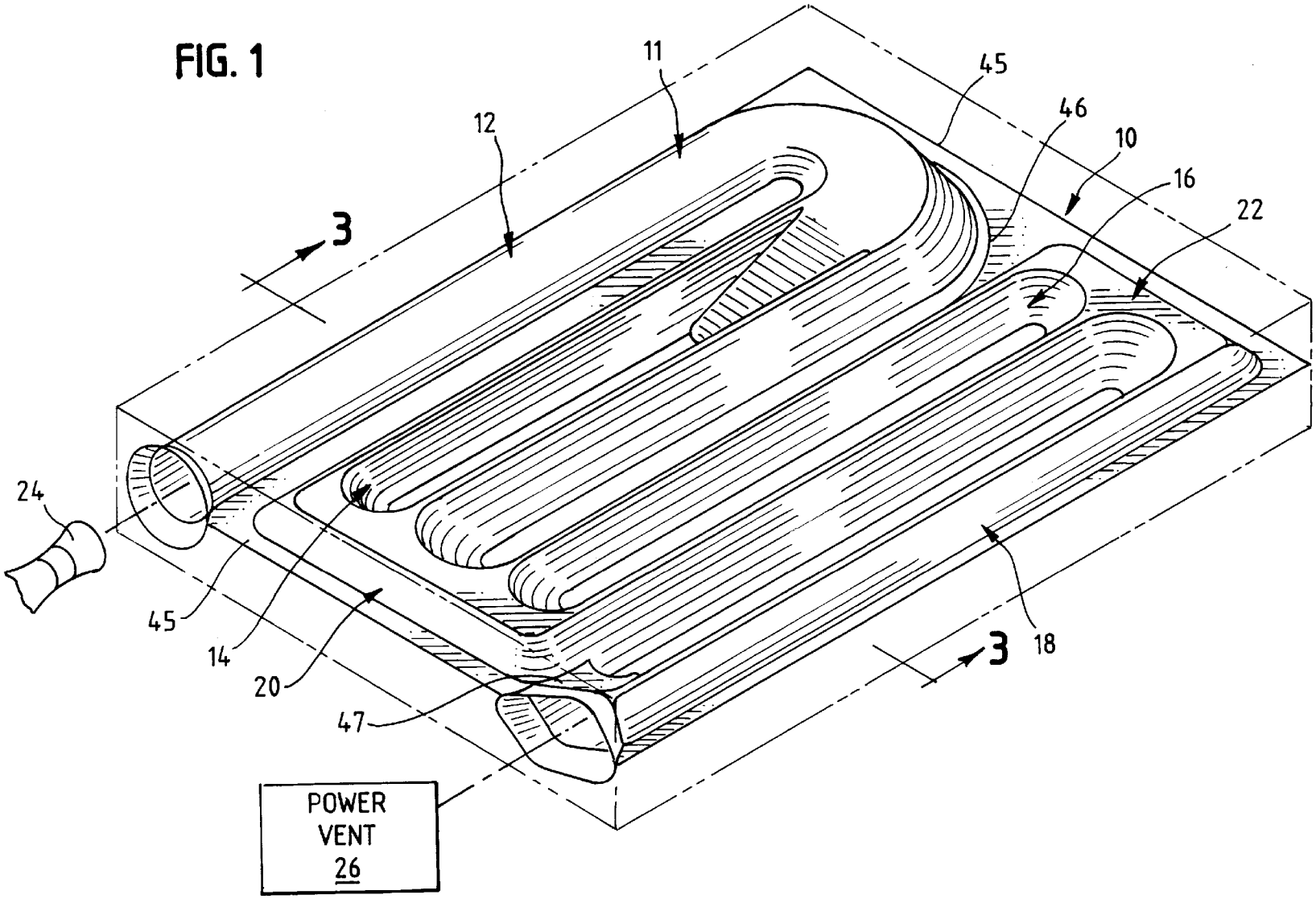
FIG. 1 is a perspective view of a clamshell heat exchanger embodying the present invention shown in combination with schematic representations of a gas inshot burner and power vent for use in a heating apparatus.

Exemplary embodiments to the heat exchanger made according to the invention are illustrated in the drawings and described herein in connection with a heat transfer function for the hot combustion gas of a heating apparatus such as a hot air furnace or a unit heater. However, it should be understood that the invention may find utility in other applications and that no limitation to use in a gas fired, hot air furnace or unit heater is intended, except as stated in the claims.

Figure 2:
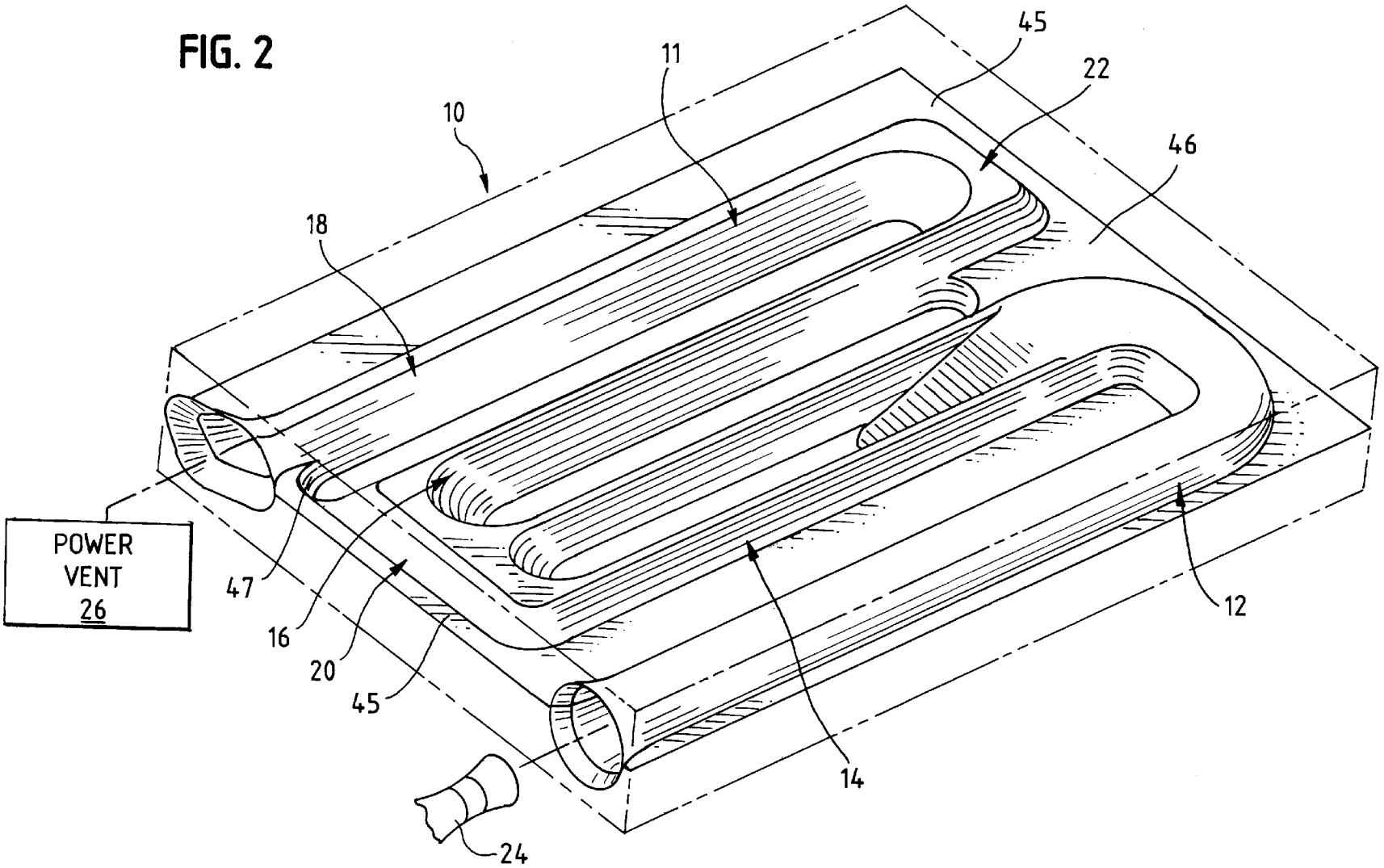
FIG. 2 is a perspective view of the opposite side of the heat exchanger shown in FIG. 1.

As seen in FIGS. 1 and 2, the heat exchanger 10 includes a four pass multi-pass flow passage 11 having a J-shaped first pass or combustion gas inlet section 12, a second pass section 14, a third pass section 16, a fourth pass or combustion gas outlet section 18, a first conduit section 20 interconnecting the second and third sections 14 and 16, and a second conduit section 22 interconnecting the third section 16 and outlet section 18. As is common in gas fired furnaces, the flow passage 11 receives hot combustion gas from an inshot burner 24, and the hot combustion gas is drawn through the passage 11 by an induction draft blower or power vent 26.

Figure 3:
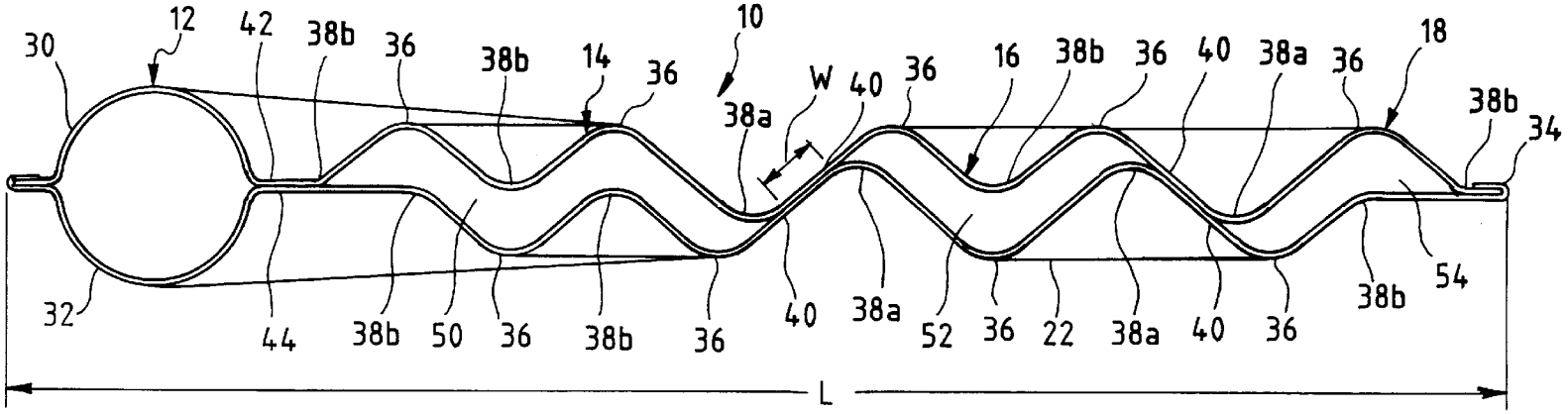
FIG. 3 is a cross-sectional view taken along line 3—3 in FIG. 1.

As best seen in FIG. 3, the heat exchanger 10 is formed from first and second plates 30 and 32 deformed from respective planes to define the flow passage 11. Preferably, the plates 30 and 32 are formed from a suitable sheet metal and are joined at the periphery by a folded crimp 34. Each plate 30 and 32 includes a series of parallel ridges 36 and valleys 38*a* and 38*b* that define the passage sections 14, 16 and 18. The valleys 38*a* in each of the plates 30, 32 are deeper than the valleys 38*b* and cooperate with the valleys 38*a* of the other plate 30 and 32 to separate the second section 14 from the third section 16 and the third section 16 from the outlet section 18. More specifically, each of the valleys 38*a* includes a wall section 40 that is non-parallel to the plane of the heat exchanger and that abuts a parallel wall section 40 of a corresponding valley 38*a* over a common length to separate the passage sections 14, 16 and 18. Preferably, each of the abutting wall sections 40 have a width W that is sufficient for the valleys 38*a* to be at least nominally sealed along the common length of the abutting wall sections 40.

The inlet section 12 is separated from the second section 14 by wall sections 42 and 44 provided on the first and second plates 30 and 32, respectively. The wall sections 42 and 44 are parallel with and lie in the plane of their respective plates 30 and 32. Preferably, the wall sections 42 and 44 are at least nominally sealed over their common length.

It should be appreciated that there must be a transition between the wall sections 40, which are nonparallel to the plane of the heat exchanger 10, and the periphery 45 of the plates 30, 32 which is parallel to the plane of the heat exchanger. As best seen in FIGS. 1 and 2, these transitions occur in a zone 46 between the second section 14 and the third section 16, and in a zone 47 between the third section 16 and the gas outlet section 18, as best seen in FIG. 2. Thus, the shape of each plate 30 and 32 extends parallel to the plane of the heat exchanger 10 into each of the transition zones 46 and 47 and changes gradually to the angle of the nonplanar wall section 40 between the periphery 45 and the beginning of each of the passage sections 14, 16. In this manner, the largest possible seal is maintained throughout each of the transition zones 46 and 47.

In a highly preferred embodiment, the wall sections 40 and the wall sections 42 and 44 are joined together with clinch holes or buttons, or staked together with a TOX® joint using tooling provided by Pressotechnik, Inc., 730 Racquet Club Drive, Addison, Ill. 60101.

As seen in FIG. 3, the second section 14 has a sinusoidal-shaped flow area 50 defined by two of the ridges 36, two of the valleys 38*b* and one of the valleys 38*a* in the first plate 30 and two of the ridges 36 and two of the valleys 38*b* in the second plate 32. The third section 16 has a sinusoidal-shaped flow area 52 defined by two of the ridges 36 and one of the valleys 38*b* in the first plate 30 and one of the ridges 36 and two of the valleys 38*a* in the second plate 32. The outlet section 18 has a sinusoidal-shaped flow area 54 defined by one of the ridges 36, one of the valleys 38*a* and one of the valleys 38*b* of the first plate 30 and one of the ridges 36 and one of the valleys 38*b* of the second plate 32. Thus, the second section 14 is defined by nine of the ridges 36 and valleys 38*a–b*; the third section 16 is defined by six of the ridges 36 and valleys 38*a–b*; and the outlet section 18 is defined by five of the ridges 36 and valleys 38*a–b*. Accordingly, the flow area 50 of the second section 14 is greater than the flow area 52 of the third section 16, and the flow area 52 of the third section 16 is greater than the flow area 54 of the outlet section 18.

Figure 4:
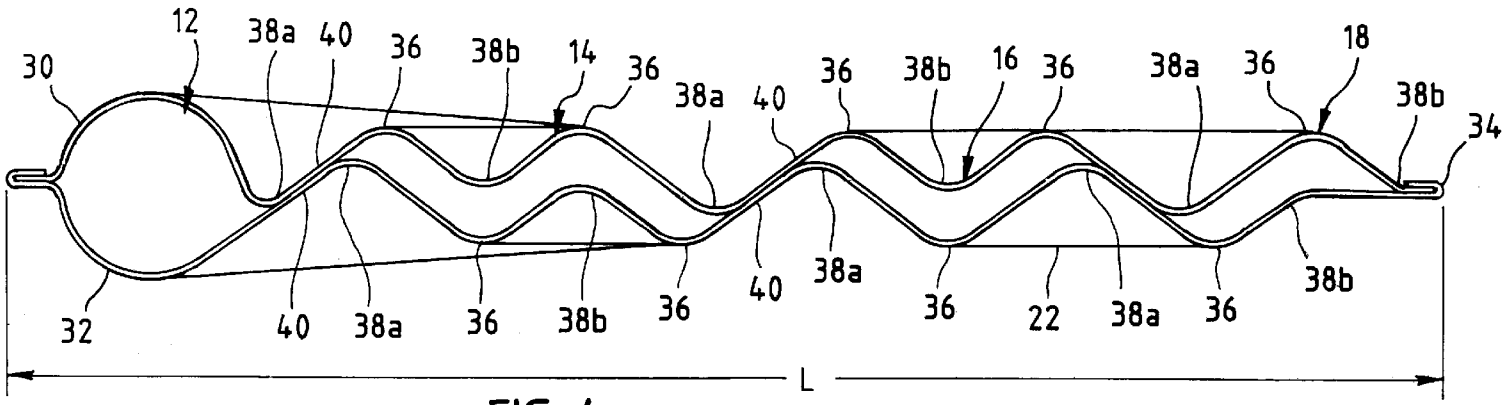
FIG. 4 is a view similar to FIG. 3, but showing an alternate embodiment of the heat exchanger.

FIG. 4 shows another embodiment of the heat exchanger 10 that is identical to the embodiment shown in FIG. 3, with the exception that each of the plates 30 and 32 has an additional valley 38*a* that replaces the wall sections 42 and 44, a valley 38*b* in the plate 30 and a valley 38*b* in the plate 32. This allows the embodiment in FIG. 4 to have a shorter length L than the embodiment in FIG. 3.

Figure 5:
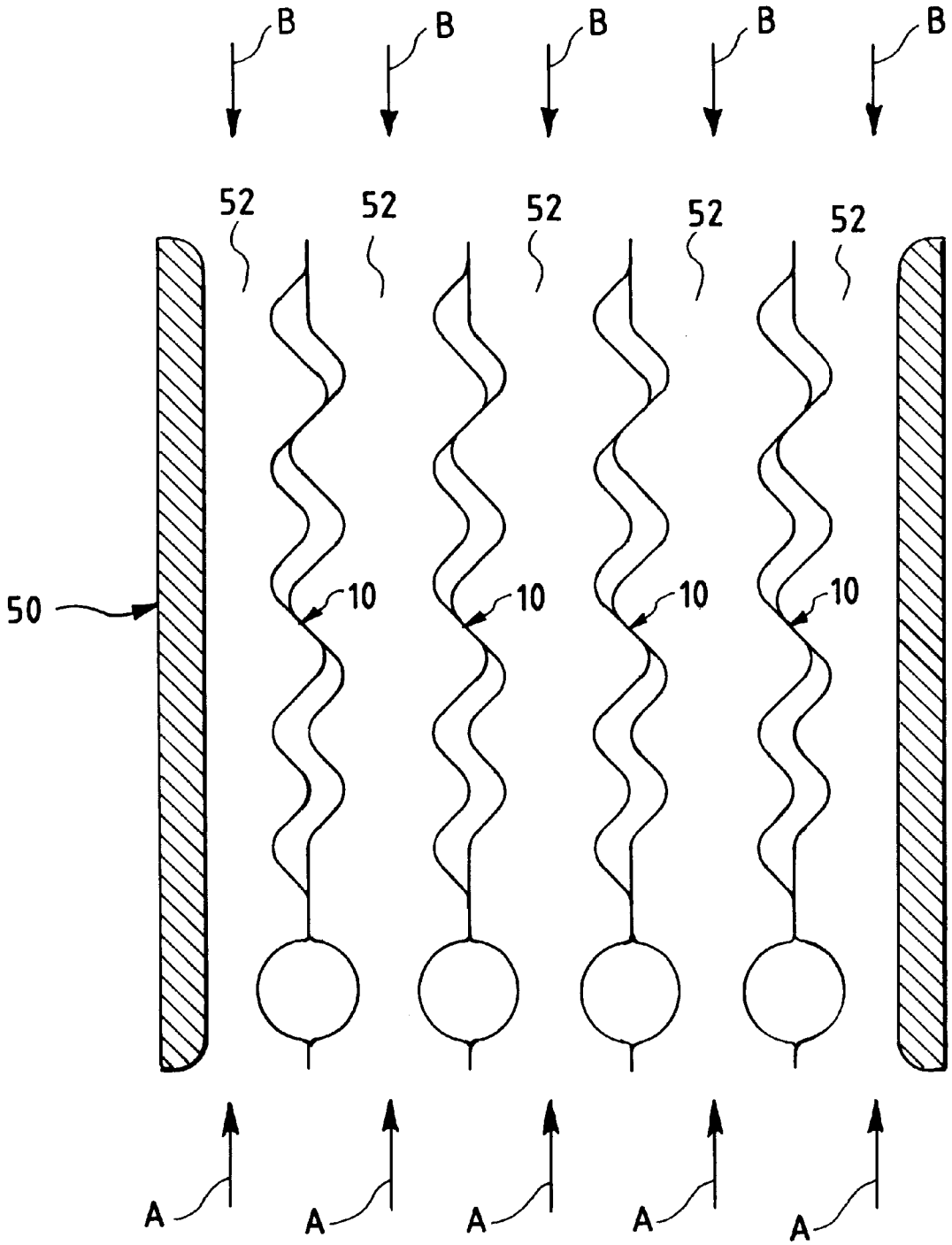
FIG. 5 is a schematic view of a plurality of heat exchangers embodying the present invention arranged in a parallel array in a heating apparatus.

As best seen in FIG. 5, a plurality of the heat exchangers 10 can be arranged in a parallel array in a furnace or unit heater 50 to define a plurality of continuous, sinusoidal flow paths 52 for the air flowing through the furnace across the exterior of the heat exchangers 10. It should be understood that the heat exchangers 10 may be installed in the furnace or unit heater 50 so that air flows through the flow paths 52 in either the direction shown by arrows A or the direction shown by arrows B. Further, it should be appreciated that the heat exchangers 10 may be arranged in the furnace or unit heater 50 with the planes of the heat exchangers 10 extending vertically and the air flow moving vertically in the flow paths 52, or with the planes of the heat exchangers 10 extending horizontally and the air flow moving horizontally in the flow paths 52.

In operation, hot combustion gas is directed into the inlet section 12 by the inshot burner 24 and continues to combust as it passes through the inlet section 12. The power vent 26 provides an induction draft which induces the hot combustion gases from the burner 24 to flow through the passage sections 12, 14, 16 and 18. The stepwise area reduction of the flow areas 50, 52 and 54 maintains a high gas velocity for the combustion gases as they flow through the passage 11.

It should be appreciated that the gentle sinusoidal shape of the plates 30 and 32 minimizes the number of sharp angles in the heat exchanger 10, thereby reducing the likelihood of premature corrosion failure resulting from damage to anti-corrosion coatings on the surface of the plates 30 and 32 during forming operations.

It should also be appreciated that the sinusoidal shape of the flow areas 50, 52 and 54 allows for an increased heat transfer surface area per unit volume while providing a relatively small hydraulic diameter and a relatively large wetted perimeter, thereby increasing heat transfer performance. Further, the passage shapes induce turbulence in the air flowing about the exterior of the heat exchanger.

It should further be appreciated that by separating the passage sections 12, 14, 16 and 18 with wall sections 40 that are non-parallel to the plane of the plates 30 and 32, the overall length L of the heat exchangers 10 can be reduced while still providing a width of contact area W between the sections that is adequate to at least nominally seal adjacent sections and to allow for an adequate structural connection.

It should also be appreciated that the peaks 36 and valleys 38*a–b*stiffen the plates 30 and 32 along the length of each of the passage sections 14, 16 and 18, thereby reducing undesirable deformation of the passage sections 14, 16 and 18 resulting from thermal induced stresses.

We claim:

1. In a heating apparatus including a burner for producing hot combustion gas and a clamshell heat exchanger receiving combustion gas from said burner for rejecting heat from the combustion gas to air flowing through the furnace, said heat exchanger defining a multi-pass flow passage for the combustion gas; the improvement wherein said heat exchanger comprises:

a first plate member having a first series of parallel ridges and valleys, at least one of the valleys being deeper than other of the valleys, a second plate member facing the first plate member, the second plate member having a second series of ridges and valleys that are parallel to the first series of ridges and valleys, at least one of the valleys of the second series being deeper than other of the valleys of the second series;

a first pass of said multi-pass flow passage defined by a number N1 of said ridges and valleys of said first and second series; and a second pass of said multi-pass flow passage defined by a number N2 of said ridges and valleys of said first and second series, said at least one deeper valley of the first series cooperating with said at least one deeper valley of the second series to separate the second pass from said first pass.

2. The improvement of claim 1 wherein N2 is less than N1.

3. In a heating apparatus including a burner for producing hot combustion gas and a generally planar, clamshell heat exchanger receiving combustion gas from said burner for rejecting heat from the combustion gas to air flowing through the furnace, said heat exchanger defining a multi-pass flow passage for the combustion gas; the improvement wherein said heat exchanger comprises:

a first plate member having a first wall section that is non-parallel to the plane of the heat exchanger;

a second plate member having a second wall section that is parallel to said first wall section and abutting said first wall section over a common length;

a first pass of said multi-pass flow passage defined by said first and second plates; and a second pass of said multi-pass flow passage defined by said first and second plates, the second pass being parallel to the first pass, the second pass separated from said first pass by said first and second abutting wall sections.

4. The improvement of claim 3 wherein said first pass has a flow area that is greater than the flow area of said second pass.

5. In a heating apparatus including a burner for producing hot combustion gas and a clamshell heat exchanger for rejecting heat from the combustion gas to air flowing through the furnace, said heat exchanger defining a multi-pass flow passage for the combustion gas, said flow passage having flow areas that decrease in the direction of combustion gas flow; the improvement wherein said flow passage comprises:

a first pass having a first generally sinusoidal shaped flow area, and a second pass downstream from the first pass and having a second generally sinusoidal shaped flow area, said second flow area being less than said first flow area.

6. A heat exchanger, comprising:

a first metallic plate having at least two sections of parallel ridges displaced to one side of the plane of the first plate, valleys between the ridges and a valley separating said sections and extending to the other side of said plane of the first plate;

a second metallic plate abutting said first plate and having at least two sections of parallel ridges displaced to the side of the second plate remote from said other side of the first plate, valleys between said ridges in said second plate, and a valley on said second plate separating said sections on said second plate and extending to the side of the plane of said second plate opposite said remote side and at least nominally sealed along its length with the valley separating the sections on said first plate;

the ridges on the two plates being oppositely directed and generally parallel to each other to form pairs of said sections;

the valleys between the ridges on said second plate being nominally aligned with the ridges on said first plate;

a combustion gas inlet to one pair of said sections;

a combustion gas outlet from another pair of said sections; and a conduit formed at the interface of said plates interconnecting said one pair of said sections to said another pair of said sections.

7. The heat exchanger of claim 6 wherein said one pair of said sections defines a flow area that is greater than a flow area defined by said another pair of said sections.

* * * * *